United States Patent [19]

Miltz et al.

[11] Patent Number: 4,919,949

[45] Date of Patent: Apr. 24, 1990

[54] REFRIGERATED DOUGH CONTAINER

[75] Inventors: Joseph Miltz, Haifa, Israel; Robert A. Strange, Crystal; Joseph C. McDilda, Brooklyn Park, both of Minn.

[73] Assignee: The Pillsbury Co., Minneapolis, Minn.

[21] Appl. No.: 254,072

[22] Filed: Oct. 6, 1988

[51] Int. Cl.[5] ..... B65D 85/36

[52] U.S. Cl. ..... 426/128; 426/122; 426/123; 206/260; 206/634

[58] Field of Search ..... 426/122, 123, 128; 206/620, 634

[56] References Cited

U.S. PATENT DOCUMENTS

| | | | |
|---|---|---|---|
| 2,855,884 | 10/1958 | Magill | 206/830 |
| 2,930,408 | 3/1960 | Stevens | 206/830 |
| 2,969,902 | 1/1961 | Cage | 206/830 |
| 2,975,068 | 3/1961 | Frenup et al. | 426/128 |
| 3,059,808 | 10/1962 | Clair, Jr. | 220/270 |
| 3,067,910 | 12/1962 | Adamsen | 220/270 |
| 3,109,576 | 11/1963 | Karl | 206/830 |
| 3,182,890 | 5/1965 | Elam | 206/830 |
| 3,182,891 | 5/1965 | Eckland et al. | 206/830 |
| 3,312,368 | 4/1967 | Reynolds et al. | 426/131 |
| 3,368,740 | 2/1968 | Rohde | 206/604 |
| 3,506,459 | 4/1970 | Parlour | 206/830 |
| 3,669,346 | 6/1972 | Leezer et al. | 206/830 |
| 3,693,785 | 9/1972 | Sincavage et al. | 206/634 |
| 3,904,060 | 9/1975 | McPhee | 215/251 |
| 3,923,182 | 12/1975 | Choksi | 215/250 |
| 3,940,496 | 2/1976 | Turpin et al. | 426/123 |
| 3,981,433 | 9/1976 | Thornhill et al. | 206/830 |
| 4,098,406 | 7/1978 | Otten et al. | 206/601 |
| 4,114,784 | 9/1978 | Hough et al. | 220/408 |
| 4,127,208 | 11/1978 | Fowles et al. | 215/32 |
| 4,163,517 | 8/1979 | Kappler et al. | 229/45 |
| 4,174,238 | 11/1979 | Fowles et al. | 156/69 |

OTHER PUBLICATIONS

The American Heritage Dictionary Second College Edition, p. 949.

*Primary Examiner*—Donald E. Czaja
*Assistant Examiner*—Evan Federman
*Attorney, Agent, or Firm*—William J. Connors

[57] ABSTRACT

A container for storage of refrigerated dough products under pressurized condition is provided. The container includes a tubular sidewall having a fracture region capable of directing fracture and end closure means for closing opposite ends of the tubular container. Refrigerated dough is contained within the container for shipping and storage.

16 Claims, 4 Drawing Sheets

+ NO PRESSURE PUNCTURE FORCE
□ PRESSURE PUNCTURE FORCE
◇ TEAR INITIATION FORCE
△ TEAR PROPAGATION FORCE

REFRIGERATED DOUGH CONTAINER

FIELD OF INVENTION

The present invention relates to a container for storing a compressed expandible food such as refrigerated dough in a pressurized condition.

BACKGROUND OF THE INVENTION

Over the past approximately forthy years, there has been a growing market for refrigerated dough products. These products are raw chemically leavened dough of various formulae. Typically, the dough is contained in tubular containers and is shipped in a pressurized condition. Typically, the pressure in the containers is about 15–20 psi, but can go as high as 35 psi. The dough weight in the containers can range from about 2 oz. to about 16 oz.

These dough products have constantly shown improvement both in quality and packaging. With regard to packaging, one of the very early containers was a convolute can as exemplified in U.S. Pat. No. 1,811,772. This particular type of container was made by wrapping of the paperboard about a mandrel to form multiple layers. After wraping of the paperboard, one end of the container was sealed with a crimped on end. The dough was placed in the partially closed container, and thereafter, the open container end was sealed with a second crimped on end. A label was placed on the outside of the tublar sidewall. This particular form of container did not lend itself well to high speed mass production, but was effective in containing the dough.

The convolute form of container, because of its shortcomings, was replaced with a helically-wrapped container which required less material, functioned just as well and better in some circumstances, and was well adapted to high speed mass production because the containers could be made continuously as opposed to a unit by unit production process for the convolute container. A typical container of the helically wound type is shown in U.S. Pat. No. 2,793,126. As in the convolute containers, the helically wrapped container had two crimped on metal ends on opposite ends of the tubular sidewall and could be lined with a water, oil and gas barrier material. The container was wrapped with a label. The helically wrapped container also provided the advantage of easy opening as exemplified in U.S. Pat. No. 3,981,433.

Further, separate containers of other food products, for example, topping, icing or the like, can be contained within the dough container as exemplified by U.S. Pat. No. 3,851,757.

Common features of the above types of containers include paperboard sidewalls; liner material to prevent the ingress or egress of materials, for example, air, water, oil, $CO_2$ and syrup; and a label to provide decoration, advertising and sidewall strength.

Although prior art containers have continually improved throughout the years, they still have certain shortcomings. Because the layers of material overlap or abut, they exhibit structural weak spots and are prone to the phenomenon called syruping. Syruping reduces the strength of the can and makes the can unappealing. Syruping is believed to be caused by loss or reduction of water binding capacity of the dough as it ages. The released water and its solutes attack any weak point in the can liner and consequently work their way to the can exterior severely weakening the can as well as making the can sticky and unappealing. Further, the paperboard sidewall is highly permeable and requires the use of impermeable liners and labels to be effective. Production of prior art containers requires multiple pieces of machinery in the production plant to wrap multiple layers of materials. Orientation of each of the layers of materials is extremely important, so the container will function properly, both in its barrier properties and in its opening features, particularly in self-opening containers. With regard to opening, if the can materials are not positioned properly, loud pops, which are objectional to consumers, can occur upon opening.

Another drawback of the above types of containers is that they do not lend themselves well to portion control. For example, if one opens a can of biscuit dough, all the dough has to be used at once. Once the container is opened, all the dough is exposed to the atmosphere, has no pressure and the container cannot be resealed to store the unused dough. To overcome this problem, different sizes of cans are provided, for example, five count and ten count, to provide portion control. However, in doing so, the economy of larger size containers is lost.

It is an object of the present invention to overcome some or all of the foregoing deficiencies of prior art refrigerated dough cans.

It is a further object of the present invention to provide a container which has an easy opening feature and good barrier properties.

It is another object of the present invention to provide an improved refrigerated dough can which can provide portion control.

It is another object of the present invention to provide a container which can be easily made in a mass production continuous manner.

It is another object of the present invention to provide a refrigerated dough can with non crimp end closure means.

It is a still further object of the present invention to provide a refrigerated dough can which can be molded from plastic materials.

It is another object of the present invention to provide a food container with an easy opening and tamper evidence features.

DETAILED DESCRIPTION OF THE INVENTION

Figure 1A:
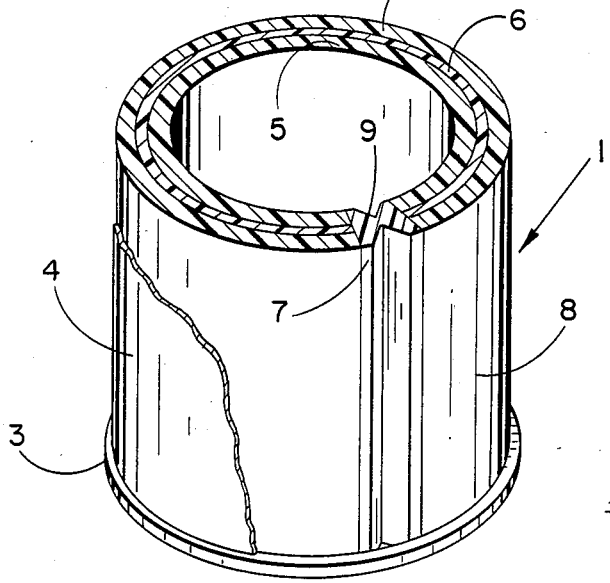
FIGS. 1(A–C) show cross-sectional views of the tubular sidewall of a pressurized food container.

The present invention relates to a food container system particularly adapted for the containment of an expandable pressurized and compressed liquid or viscoelastic material such as food which is to be stored under pressurized conditions. By expandable and compressed what is meant is that the contained product has a volumetric increase of at least about 35% and preferably at least about 55% when the pressure is reduced from the storage pressure to ambient pressure. A food product of this type is refrigerated dough. Such foods will contain dissolved or compressed gas interspersed in a liquid or viscoelastic mass. The expansion of the gas within the product causes the volumetric expansion of the food product upon reduction of the surrounding pressure. Hereinafter, such foods will be referred to generally as refrigerated dough for the sake of brevity. Preferably, the food product is also viscous, having a viscosity in the range of between about 300–900 Brabender Units (BU) as measured by ACC 54-28A testing procedure. Dough can also be considered a viscoelastic substance.

The present invention container can be made from thermoplastics, e.g., polyolefins like homo- or copolymers of propylene and ethylene, polyethylene terephthalate (PET), or polyvinyl chloride (PVC) as the main structural component of the tubular sidewall 1, the divider 37 and ends 3.

The tubular sidewall 1 can be extruded or injection molded as is known in the art to form an integral structure. Preferably, the sidewall is co-extruded and can have multiple layers of structural material 5 and can optionally have a layer of barrier material 6 coated or co-extruded on one surface thereof or two surfaces (inner and outer) or coextruded between two layers of structural material 5 to form an integral structure. It is preferred that the multiple layers of the sidewall portion 8 remian generally distinct from i.e. not become a part of the area 7, to insure operation. Also, the sidewall 1 can have a label 4 wrapped therearound for strength and can have positioned therein or therearound a liner of aluminum foil or a gas barrier plastic to provide gas barrier properties.

In cross-section, the tubular sidewall 1 can be any suitable shape, for example, round, oval, hexagonal or the like. However, round is a preferred cross-sectional shape for ease of manufacturing and uniform distribution of stresses in the container.

Figure 1B:
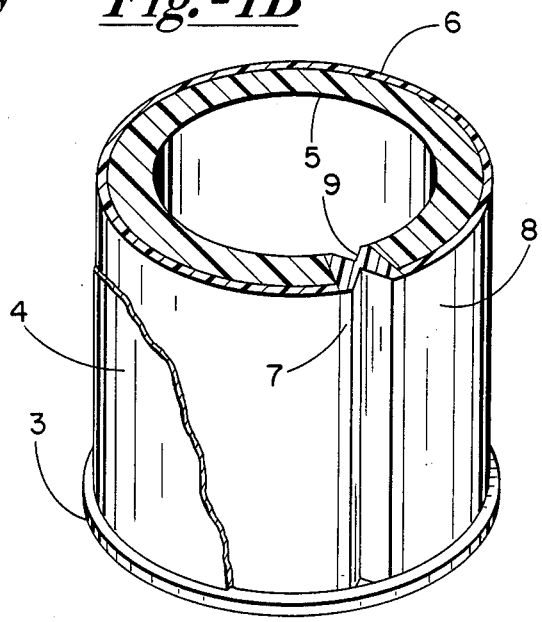
Figure 1C:
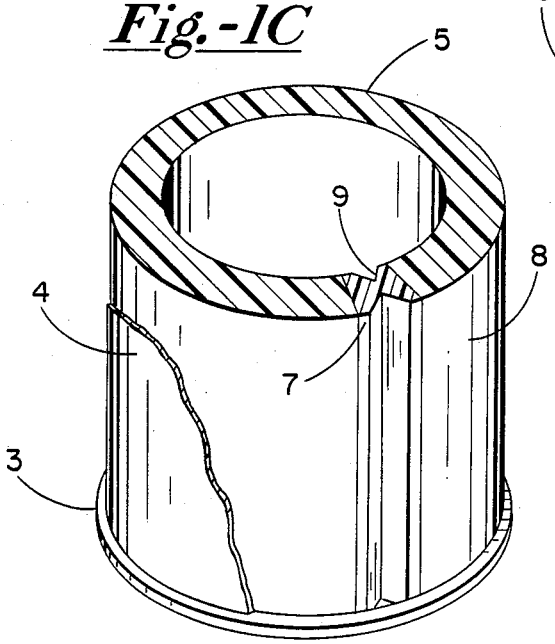

As best seen in FIG. 1C, there is a generally longitudinally extending area 7 which extends generally from one end of the sidewall to the opposite end of the sidewall. The area 7 can be any suitable shape for example a helix or generally straight. The area 7 is preferably formed during the molding process or can be formed after the molding process and is formed so that it functions as if it is integral or is integral with the area 8. The area 7 is preferably formed of a relatively brittle material, while the area 8 is preferably formed of a relatively flexible material.

The properties of the area 7 should be sufficient to provide a balance between brittleness i.e. it should not be too brittle or too flexible as hereinafter defined. This will allow for proper opening to release the pressurized contents, reducing the damage to the product if opened too slowly and the opening force impact if opened too quickly. It has been common that fast opening of pressurized products can sometimes cause a loud noise which is detrimental to product acceptance. The properties of the material in the area 7 should be sufficient to allow for the appropriate fracture rate. In this regard, the below described properties provide for acceptable opening when refrigerated dough is the contained food product. This also equates to the pressure release rate, i.e. the rate of release of product pressure should be controlled and can be easily accomplished by the fracture (tear propagation) rate of the area 7.

It has been found that by containing refrigerated dough or the like, i.e. a compressed and expandable product, that effective opening can be achieved using plastic materials in the area 7 and also preferably area 8. Plastic (polymers) are strain rate sensitive while other materials like metal may not be so. Another unique aspect of plastic materials, unlike metals, is that the fracture initiation force is significantly higher than the fracture propagation force. The combination of food product and container sidewall material allows for a unique ability for storing pressurized compressed expandable materials. In a preferred embodiment it is preferred that the ratio of tear initiation force to tear propagation force be in the range of about 4:1 to about 7:1 and preferably 5:1 to 6:1. Typical metals do not exhibit this property and therefore would not be usable in this food product system.

The below describes a preferred embodiment of the present invention which utilizes two different materials in the sidewall, i.e. a relatively brittle and a relatively flexible material. This results in effective fracture propagation along the weakened area. However, it is to be understood that a single material sidewall can be utilized as long as it has the described tear initiation force and propagation force ratios and the tear initiation force as described herein.

The area 7 should also have one or more stress concentrators formed therein extending along at least a portion of the length thereof. The stress concentrator 9 can typically take the form of a groove which reduces the sidewall thickness and acts as a stress level raiser (primarily at the tip or apex) to provide opening ease, and location and direction of fracture or tear. It is preferred that the groove be generally V-shaped and reduce the sidewall to a thickness at the apex which is in the range of between about 50% and about 90% of the sidewall thickness. The sidewall 1, portion 8 and section 7 thickness, exclusive of the stress concentration, will normally be in the range of between about 0.010 inches and about 0.030 inches. For pressurized dough containers, the minimum wall thickness at the stress concentrator 9 is preferably in the range of between about 0.010 inches and about 0.024 inches. A groove 9 can be in each surface of the area 7 as shown. The stress concentrator 9 permits easy opening and controls the location and direction of fracture. The stress concentrator 9 can reduce the need for different materials in the portion 8 and section 7.

The function of the area 7 and/or the stress concentrator 9 is to provide a break area for opening the container. It allows the consumer to easily open the container and permit self propagation of the fracture once initiated under the pressure and expansion of the contained dough material. A balance of material properties is utilized to allow the container to withstand normal distribution abuse which can be due to handling or temperature cycling of the product while still allowing easy opening. The area 7 and/or the stress concentrator 9 also contains or limits the direction of propagation of the fraction once initiated.

A molded section can be utilized for the section 7 or, a peel strip as are known in the art, can also be provided so long as it provides the preferential breaking. A peel strip is a strip of material which would be differentially bonded to the opposite edge of the section 8 in such a manner that the bond is weaker than the peel strip material or the section 8.

Brittleness can be related to the elongation of the material at the breaking point. This elongation at the break point is measured as the ratio of the length at break to the original sample length according to ASTM D638 or D882. The lower the ratio the more brittle the material. It is preferred that the elongation of the brittle break area 7 be less than about 120 percent and more preferably less than about 110 percent and most preferably less than about 100 percent. The flexible area 8 preferably has an elongation of greater than about 150 percent and more preferably greater than about 200 percent and most preferably greater than about 300 percent. In a preferred embodiment of the invention, elongation of the area 8 is about 340 percent and is about 3 times geater than that of area 7.

The area 7 should be sufficiently brittle so that it can be easily fractured by a consumer. The tear or fracture initiation and propagation forces of the section 7 can be measured by ASTM 1938. The propagation force or strength should be sufficiently low to provide for self propagation of the fracture after initiation. The tear propagation force of the material comprising the breakable portion of the section 7 should be in the range of between about 0.5 lb and about 4.0 lb, preferably in the range of between about 1.0 lb and about 3.0 lb and most preferably in the range of between about 1.5 lb and about 2.5 lb. This will allow self propagation of the fracture after initiation. The important criteria for the brittleness and tear initiation force of the portion 7 is that it be sufficiently strong to withstand shipping and handling abuse while being sufficiently brittle to allow the container to be easily opened by a consumer. Further, it is belived important that the area 8 be sufficiently flexible to prevent the container from being damaged during shipping and handling by providing energy absorbence.

Figure 5:
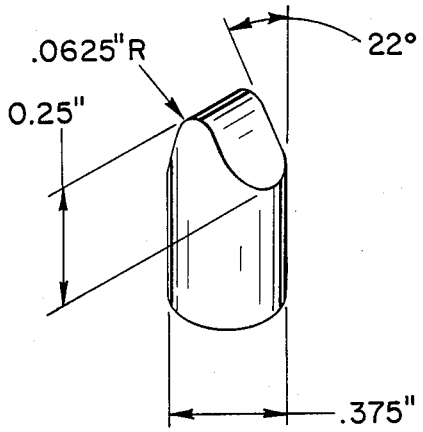
FIG. 5 is a perspective view of a test probe.

To provide ease of opening, the puncture force applied by the consumer should be kept minimal while still maintaining sufficient structural strength to prevent premature fracture during shipping and handling. It is preferred that this force be less than about 30 lbs., preferably less than about 25 lbs. and more preferably less than about 20 lbs. The puncture force should be greater than about 12 lbs. These forces are measured by the following test using an Instron model 1125. The feed rate of the probe is 0.5 in/min. The probe is wedge-shaped and the dimensions are shown in FIG. 5.

Figure 6:
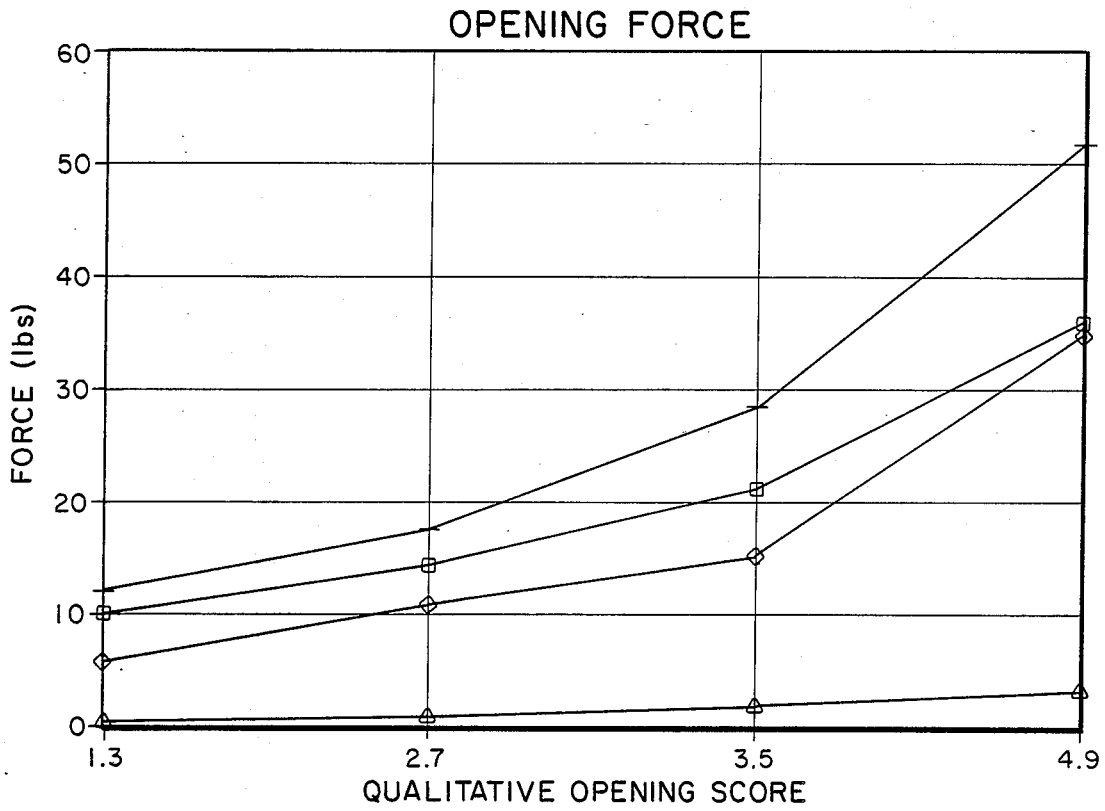
FIG. 6 is a graph showing opening forces versus subjective opening scores for ease of opening.

The probe is positioned along the section 7 immediatley above the stress concentrator 9 and in alignment therewith. The opening force is the maximum force achieved by the Instron prior to fracture of the section 7. The container samples used cirmped on metal ends. A union joint was attached to the body to introduce air to pressurize the container to a predetermined pressure. The container was positioned in a cradle which closely fit the exterior contour of the container. The applied force was measured with the Instron machine. FIG. 6 shows the force required to open (puncture) containers as well as forces necessary for this opening to extend (propagate) to the end of these containers as related to a qualitative opening score. A test was developed to replicate consumer opening of the container. A "qualitative opening score" was created with the following definitions.

| Score | Definition |
|---|---|
| 0 | opens during proofing |
| 1 | easily opened with fingertip |
| 2 | could be opened by fingertip |
| 3 | cannot open by hand/easily opened with tip of spoon |
| 4 | difficult to open with tip of spoon |
| 5 | unable to open with spoon |

The container was placed on a table top and opening was attempted by fingertip and/or using a kitchen implement such as a spoon. A score was obtained according to the difficulty of opening. Values are typically an average of at least 5 containers.

Tear initiation was measured according to ASTM 1938 where the slitting of the sample prior to testing was not included. Tear initiation is a measure of the force required to begin the tear of the opening area. Tear propagation force was measured according to ASTM 1938.

It is preferred that tear initiation force or strength be greater than about 10 lb. and less than about 20 lb. and tear propagation force be less than 4 lb. and greater than about 0.5 lb. The thickness of the section 7 was in the range of about 0.018–0.035 inches and the thickness of the wall at the stress concentrator was in the range of about 0.016–0.024 inches. FIG. 6 graphically depicts the results.

In operation, the consumer can open the container by simply pressing inwardly on the section 7, using a fingertip or kitchen implement such as a spoon. A fracture will result at the stress concentrator. During puncture, the crack will initiate and propagate toward the opposite ends of the container because of the expansion of the product in the container. The resulting opening allows the removal of the product.

As shown, the portion 8 in a two material sidwall form, is the major portion of the sidewall 1 and preferably is at least 80% of the sidewall on an area or circumference basis.

It is to be understood that a label 4 can be wrapped around the sidewall to provide both structural strength, if needed, and also an area for high quality advertising and product description. The label 4 can be either convolutely-wrapped or helically-wound about the tubular sidewall 1 and be suitably secured in position, for example, by gluing. Advertising can also be achieved by printing on the container.

Figure 3:
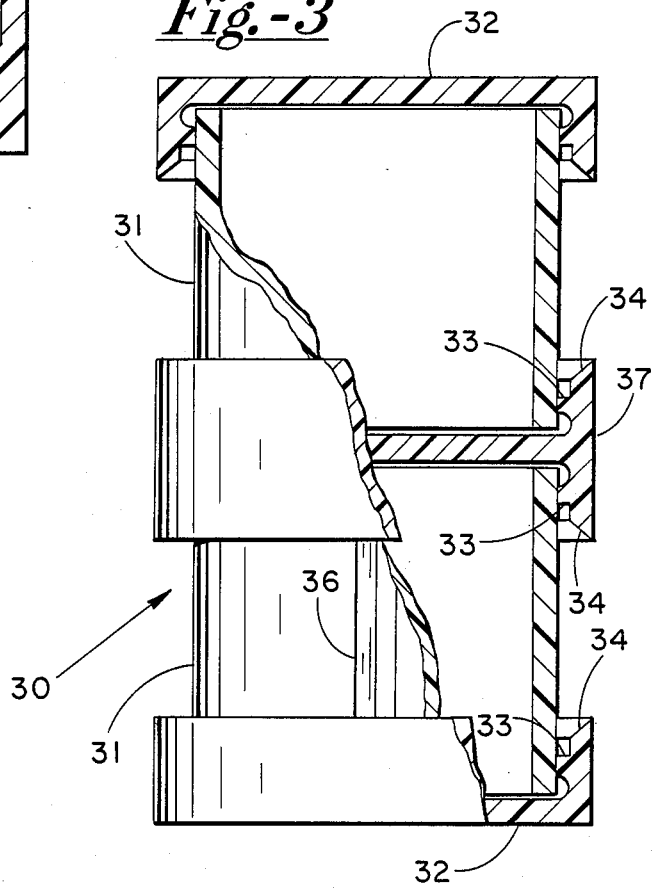
FIG. 3 shows a fragmentary sectional view of another modification of the present invention adapted for portion control.

FIG. 3 shows another form of the present invention. The container 30 has a tubular sidewall 31 which can be molded as the containers shown in FIGS. 1A–C. The tubular sidewall 31 has a relatively brittle area 36 similar to the area 7. The container 30 also has an end closure 32 which is preferably injection molded from the same or similar material as the container body and can be coated or coinjection molded with a gas barrier material. Another method would be to thermoform the end from a multilayer sheet. The end closure 32 can be secured to the sidewall 31 in any suitable manner. In the form of the invention shown, the closure 32 has an inwardly radially-directed rib 33 and a tapered lead-in skirt 34. The diameter of the rib 33 is such as to closely fit against the sidewall 31. Means of securing the closure 32 to the sidewall 31 can be by gluing or welding. A closure 32 can be provided on both ends of the container 30.

It has been found that good success can be achieved with metal end closures 32. Because of the use of a crimp on sealing method the plastic in the area of the crimp is compressed. However, no detrimental creep of this area, even at the high container pressures utilized, has been noticed.

A divider 37 can be provided if one desires to have portion control. The divider 37, as shown, is similar to the closure 32, but has two ribs 33 and tapered lead-ins 34 to accommodate the two tubular sidewall sections. As with the end closure 32, the divider can be suitably secured to the respective sidewall 31.

Figure 2:
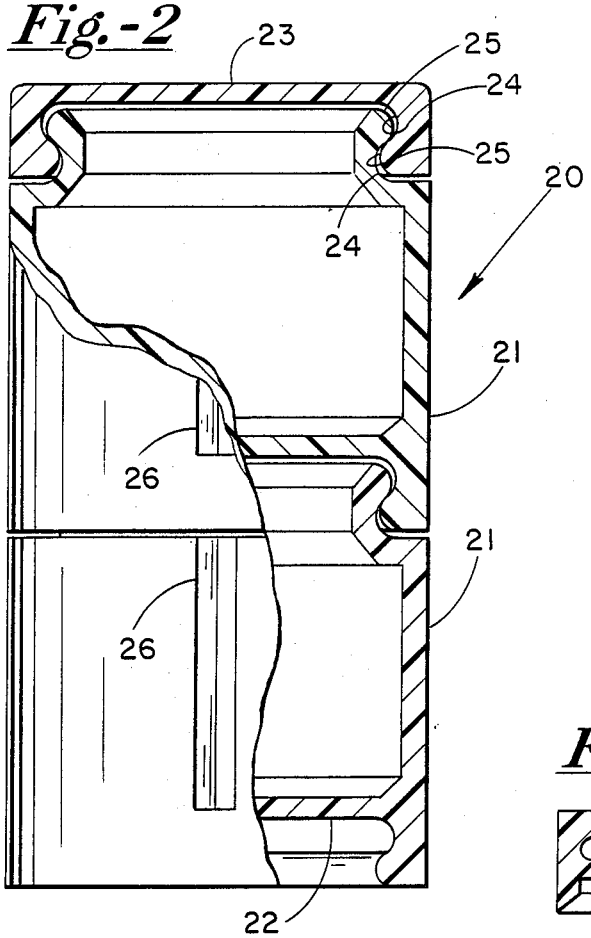
FIG. 2 shows a fragmentary sectional view of a modified form of the present invention adapted for portion control.

Container 20 is shown in FIG. 2. The container 20 has a tubular sidewall 21, which in the illustrated form, can be in the form of an injection molded unit having an integral bottom 22 closing one end thereof. It can also have an injection molded cap 23 suitably secured to the open end thereof. In the form of the invention shown in FIG. 2, the end 23 is physically interlocked with the sidewall 21 as by interengaged grooves and rings, 24 and 25, respectively. The sidewall 21 and bottom 22 can have a relatively brittle area 26 similar to the area 7. Further, it is to be noted that the sidewall 21 can have coated or co-molded multiple layers like the structures shown in FIGS. 1A, 1B and 1C.

It can be seen that the form of the invention shown in FIG. 2 can provide portion control by attachment of a plurality of containers in end to end relationship.

It can be seen that the form of the invention shown in FIGS. 2 and 3 provide a simple means for portion control and/or opening as does the form of the invention shown in FIGS. 1A–C.

Figure 4:
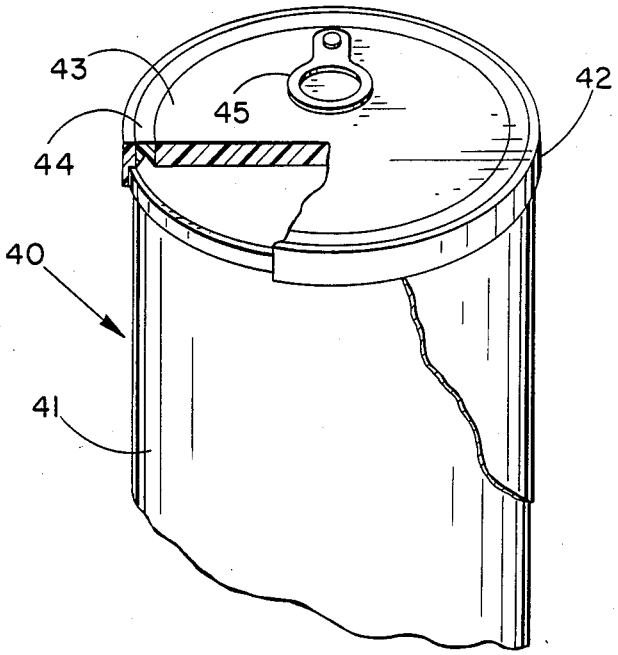
FIG. 4 is a fragmentary perspective view of another modified form of the present invention showing a container which also provides tamper evidence.

FIG. 4 shows a modified form of the present invention. The container 40 includes tubular sidewall 41. An end closure 42 is on one end. The end 42 can be injection molded as an integral part of the wall 41 or can be glued or welded thereon or otherwise suitably attached to the sidewall 41 in the manner shown above for the forms of the invention shown in FIGS. 1A–C and in FIGS. 2 and 3. As shown, the container 40 is provided with an end closure 43 which can be similar to the closure 42 and is suitably secured to the opposite end of the container from the closure 42. The container 40 has a brittle area 44 like the area 7 in the end closure 43. The relative sizes of the areas 44 and 43, on an area basis, can be the same as described above for the areas 7 and 8 respectively. The relatively brittle area 44 can be in the same form as the area 7 and can include a stress concentrator. A pull tab 45, as is known in the art, can also be provided. The form of the invention shown in FIG. 4 can contain either pressurized or nonpressurized food products. If someone tampers with the container to try to open it, the fracture in the area 44 will be readily apparent providing tamper evidence. It is to be understood that the container 40 can also be made by an extrusion process as described above.

The particular form of the invention shown in FIG. 4 can also be made using a paper sidewall as is typically done or a sidewall as described herein. The end closure in this case is plastic as above described for the sidewall 1. It has been found that with a container of this type having a diameter of up to about 6 inches the pressurized dough can still be adequately stored. In this particular execution it is preferred that the dough have a formula that is less viscous than typical dough allowing spooning of the dough from the container. Lower viscosity is normally achieved by the addition of extra water or other plasticizer like fat.

| DROP BISCUIT W/SUGARS | |
|---|---|
| INGREDIENT | WEIGHT % |
| WATER | 31.030 |
| ENRICH | 0.007 |
| HARD FLOUR | 45.472 |
| SAPP | 0.805 |
| SODA | 0.966 |
| SALP | 0.451 |
| NFOM | 0.644 |
| SALT | 1.128 |
| SHORTENING | 9.987 |
| SUCROSE | 2.255 |
| DEXTROSE | 7.255 |

The present invention was reduced to practice by the use of an extruded sidewall tube 1. The major portion 8 was made of a co-polymer of propylene and the area 7 was made of mineral (calcium carbonate) filled copolymer of propylene. The wall thickness was 0.022 inches and the stress riser was generally V-shaped leaving a wall thickness at the thinnest point of 0.016 inches. The tube was coated with polyvinyl dichloride (PVDC) for gas barrier properties. Dough was placed in the container and the ends were sealed with crimped on metal closures as are used today with the helically-wound paper containers. After the container was sealed and the dough expanded, the gases in the headspace of the container were easily exhausted between the sidewall and the end closures with the dough filling the chamber and sealing the seams between the sidewall and the end closures. The container had no headspace and was full of product. The outer joint between the sidewall 1 and the end closure 2 were sealed with an epoxy resin, after the dough had expanded. The dough in the container achieved a pressure of about 20 psi and was stored for 120 days. The container remained intact, i.e., did not rupture, nor were any problems exhibited, for example, syruping or the like. By applying a force with fingertips or a spoon at the area 7, generally centrally between the two opposite ends, the container opened easily. By pulling the two opposite edges of the area 7 apart the dough was easily removed without damage from the container. It can be seen that the present container eliminates wetting of the paper and the syruping problems with currently used cans.

The foregoing description of the specific embodiments reveals the general nature of the present invention so that others can readily modify and/or adapt the invention for various applications. It is to be understood that the phraseology or terminology employed herein is for the purpose of description and not of limitation. The invention is not limited by the specific disclosures herein, except to the extent that such limitations are found in the claims.

What is claimed and desired to be secured by Letters of Patent is:

1. A food storage system for the storage and distribution of food products, said system comprising:

a thermoplastic tubular sidewall having a major first region and an integral second fracture region extending generally between opposite ends of said tubular sidewall said second fracture region having a tear initiation strength at least about 4 times greater than a tear propagation strength being operable to control the course of a fracture after initiation:

end closure means secured to said sidewall and closing said opposite ends of said tubular sidewall; and a pressurized food product contained in said container.

2. A system as set forth in claim 1 wherein:

said fracture region has a stress concentrator therein.

3. A system as set forth in claim 1 or 2 wherein:

said tubular sidewall has a plurality of layers integral with one another and either co-formed therewith at least in the first region of said tubular sidewall, or coated on at least a portion of the sidewall.

4. A system as set forth in claim 1 or 2 wherein:

said tubular sidewall is co-extruded from thermoplastic material.

5. A system as set forth in claim 1 or 2 wherein:

said tubular sidewall in injection molded from thermoplastic material.

6. The system as set forth in claim 1 or 2 wherein:

at least one of said end closure means is injection molded as part of and integral with said sidewall.

7. A system as set forth in claim 1 or 2 wherein:

said tear initiation strength being at least about 5 times greater than the tear propagation strength.

8. A system set forth in claim 1 or 2 wherein:

said tear initiation strength being in the range of between about 4 and about 7 times greater than the tear propagation strength.

9. A system as set forth in claim 1 or 2 wherein:

said tear initiation strength being in the range of between about 5 and about 6 times greater than the tear propagation strength.

10. A system as set forth in claim 1 or 2 wherein:

said tear propagation strength is in the range of between about 0.5 lb. and about 4.0 lb.

11. A system as set forth in claim 10 wherein:

said tear initiation strength is in the range of about 10 lb. to about 20 lb.

12. A system as set forth in claim 1 or 2 wherein:

said food product is dough.

13. A system as set forth in claim 1 or 2 wherein:

said food product is compressed and expandable.

14. A systsem as set forth in claim 1 or 2 wherein:

said first region is relatively flexible and said second region is relatively brittle.

15. A system as set forth in claim 14 wherein:

said first region has an elongation greater than about 150 percent and said second region has an elongation of less than about 120 percent.

16. A system as set forth in claim 1 or 2 wherein:

said second region includes a peel strip.

* * * * *